US009665044B2

(12) United States Patent
Sato et al.

(10) Patent No.: US 9,665,044 B2
(45) Date of Patent: May 30, 2017

(54) IMAGE FORMING APPARATUS, IMAGE FORMING METHOD, AND TRANSFER VOLTAGE CONTROL PROGRAM

(71) Applicant: Konica Minolta, Inc., Chiyoda-ku, Tokyo (JP)

(72) Inventors: Yuya Sato, Fuchu (JP); Atsuto Hirai, Ikoma (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 15/049,214

(22) Filed: Feb. 22, 2016

(65) Prior Publication Data

US 2016/0282771 A1 Sep. 29, 2016

(30) Foreign Application Priority Data

Mar. 25, 2015 (JP) ..... 2015-062831

(51) Int. Cl.
*G03G 15/16* (2006.01)
*G03G 21/00* (2006.01)

(52) U.S. Cl.
CPC ..... *G03G 15/1665* (2013.01); *G03G 21/0094* (2013.01); *G03G 2215/00569* (2013.01)

(58) Field of Classification Search
CPC ..... G03G 21/1825; G03G 2215/1652
See application file for complete search history.

(56) References Cited

U.S. PATENT DOCUMENTS

2006/0182466 A1* 8/2006 Oda ..... G03G 21/0005 399/253
2013/0058666 A1* 3/2013 Takahashi ..... G03G 21/00 399/38
2013/0156455 A1* 6/2013 Kakehi ..... G03G 15/18 399/66

FOREIGN PATENT DOCUMENTS

JP 2000-221838 A 8/2000
JP 2006276764 A * 10/2006
JP 2008-310194 A 12/2008
JP 2009-216784 A 9/2009

(Continued)

OTHER PUBLICATIONS

JP_2006276764_A_T Machine Translation, Japan, Kawai, Oct. 2006.*

(Continued)

*Primary Examiner* — Clayton E Laballe
*Assistant Examiner* — Victor Verbitsky
(74) *Attorney, Agent, or Firm* — Buchanan Ingersoll & Rooney PC

(57) ABSTRACT

An image forming apparatus includes: a latent image bearing body on which a latent image is formed; a lubricant supplying unit configured to supply lubricant to the latent image bearing body; a developing unit configured to develop the latent image as a toner image by supplying the lubricant taken in from the latent image bearing body to the latent image bearing body together with charged toner; a transfer unit configured to transfer the toner image to an image bearing body at a transfer position by applying a transfer voltage to the toner image; and a control unit configured to control application of the transfer voltage, wherein the lubricant is charged to a polarity opposite to a charging polarity of the toner, and based on an area ratio of a (Continued)

transferred image and the number of transferred sheets, the control unit controls the transfer voltage to be applied.

18 Claims, 4 Drawing Sheets

(56) References Cited

FOREIGN PATENT DOCUMENTS

| | | | |
|---|---|---|---|
| JP | 2010-256629 | A | 11/2010 |
| JP | 2011-028202 | A | 2/2011 |

OTHER PUBLICATIONS

Notice of Reasons for Rejection dated Mar. 7, 2017 issued by the Japanese Patent Office in corresponding Japanese Patent Application No. 2015-062831 and English translation (10 pages).

* cited by examiner

IMAGE FORMING APPARATUS, IMAGE FORMING METHOD, AND TRANSFER VOLTAGE CONTROL PROGRAM

The entire disclosure of Japanese Patent Application No. 2015-062831 filed on Mar. 25, 2015 including description, claims, drawings, and abstract are incorporated herein by reference in its entirety.

BACKGROUND OF THE INVENTION

Field of the Invention

The present invention relates to an image forming apparatus, an image forming method, and a transfer voltage control program.

Description of the Related Art

In electrophotographic type image forming apparatuses, a technique of providing a cleaning apparatus on a latent image bearing body or an intermediate transfer body is known. This technique is provided for the purpose of removing residual toner such as untransferred toner and transfer residual toner on the latent image bearing body or the intermediate transfer body. As an exemplary cleaning apparatus, a blade cleaning system is known. The blade cleaning system uses a flat plate-shaped cleaning blade formed of an elastic body. The cleaning blade is abutted against a surface of the latent image bearing body and of the intermediate transfer body, thereby removing residual toner on the latent image bearing body and on the intermediate transfer body.

In recent years, in the electrophotographic type image forming apparatuses, there have been demands for micronization of toner particles in view of achieving higher image quality. As methods for creating micronized toner particles, for example, polymerization methods including emulsion polymerization and suspension polymerization are known. However, the smaller the toner particles become, the greater adhesion occurs between the toner particles and the latent image bearing body, causing difficulty in removing residual toner on the latent image bearing body. In particular, in a case where toner is generated by using polymerized toner produced by polymerization, the shape of the toner particle is substantially spherical. In this case, the toner particle tends to roll on the latent image bearing body and pass through the cleaning blade. Due to this tendency, a cleaning failure is likely to occur, leading to increased difficulty in removing residual toner on the latent image bearing body.

Generation of the toner passing through the blade would cause a toner aggregate to be formed around initial toner as a core on the latent image bearing body. This would cause a white spot (granular noise) to be formed at a portion where a solid image is printed.

In order to cope with a quality issue of "granular noise", cleaning is currently performed in a state where lubricant is supplied on the latent image bearing body so as to form a lubricant coating to decrease adhesion between the toner particles and the latent image bearing body. As a method of supplying lubricant on the latent image bearing body, a lubricant application method is known. The lubricant application method allows a brush to be abutted against a stick-shaped lubricant so as to scratch a portion of the lubricant and then supply the portion of the lubricant to a surface of the latent image bearing body.

According to the lubricant application method, the portion of lubricant supplied onto the surface of the latent image bearing body by the brush comes in contact with a developing sleeve of a developer container, or the like. By this contact, the portion of lubricant is scratched from the surface of the latent image bearing body and taken into the developer container. The lubricant taken in is mixed with the toner while being conveyed inside the developer container and re-supplied to the latent image bearing body together with the toner supplied at the developing unit. In printing a low area ratio (printing ratio) image for which a toner consumption amount is small, the amount of toner used for developing would be reduced. Accordingly, the amount of lubricant re-supplied with the toner would be reduced. Meanwhile, supply of lubricant onto the surface of the latent image bearing body from the brush and scratching of lubricant from the surface of the latent image bearing body occurring at the developing unit are not very much influenced by the toner consumption amount or the area ratio. Accordingly, continuing printing of low area ratio images would increase the amount of lubricant inside the developer container. Conversely, continuing printing high area ratio images would decrease the amount of lubricant inside the developer container. In short, in the lubricant application method, the amount of lubricant in the developer container varies depending on the toner consumption amount.

For example, when the amount of lubricant inside the developer container after a low area ratio image has been printed, the ratio of the lubricant to the toner inside the developer container increases. In this case, the amount of lubricant that moves onto the latent image bearing body together with the toner increases at an image portion (portion to which toner is attached due to a potential difference at the developing unit and developed). The toner on the image portion including a large amount of lubricant is transferred at the transfer unit to the intermediate transfer body. As a result, a portion with a large amount of lubricant is generated also on the intermediate transfer body.

When such a portion with a large amount of lubricant is generated on the intermediate transfer body, the large amount of lubricant on the portion would be aggregated by incorporating foreign objects such as paper dust, so as to form an aggregate. The aggregate is conveyed on the intermediate transfer body and caught at a portion between the intermediate transfer body and the cleaning blade provided on the intermediate transfer body. When the aggregate is caught, an edge of the cleaning blade is pushed up, causing a failure in retaining an abutted state between the cleaning blade and the intermediate transfer body. This causes toner particles to pass through the cleaning blade in the vicinity of the portion where the aggregate is caught, leading to occurrence of a cleaning failure. Regarding this issue, there is a known technique (refer to JP 2010-256629 A). According to JP 2010-256629 A, lubricant is applied to the latent image bearing body, and then, according to a result of detection of a friction coefficient of the intermediate transfer body, the toner input amount to the intermediate transfer body is controlled, thereby controlling the amount of lubricant on the intermediate transfer body.

Unfortunately, however, the technique described in JP 2010-256629 A controls the toner input amount to the intermediate transfer body. Therefore, the technique described in JP 2010-256629 A is not executable in an image region where a usual image corresponding to a document image is formed, but only executable suitably in a non-image region other than the image region. For example, execution of the method described in JP 2010-256629 A at a time of transfer of an image in the image region might influence the quality of the image to be formed due to a change in the toner input amount.

SUMMARY OF THE INVENTION

The present invention has been made in view of the above circumstance, and an object thereof is to provide an image forming apparatus, image forming method, and a transfer voltage control program, capable of controlling the amount of lubricant on the intermediate transfer body even when an image is transferred in the image region.

The above-described object is achievable by using the techniques below.

(1) To achieve the abovementioned object, according to an aspect, an image forming apparatus reflecting one aspect of the present invention comprises: a latent image bearing body on which a latent image is formed; a lubricant supplying unit configured to supply lubricant to the latent image bearing body; a developing unit configured to develop the latent image as a toner image by supplying the lubricant taken in from the latent image bearing body to the latent image bearing body together with charged toner; a transfer unit configured to transfer the toner image to an image bearing body at a transfer position by applying a transfer voltage to the toner image developed by the developing unit; and a control unit configured to control application of the transfer voltage at the transfer position, wherein the lubricant is charged to a polarity opposite to a charging polarity of the toner at the transfer position, and based on an area ratio of a transferred image and the number of transferred sheets at a certain timing, the control unit controls the transfer voltage to be applied at a time of transfer of the toner image after the certain timing.

(2) The image forming apparatus of Item. 1, wherein the control unit preferably determines whether the area ratio of the transferred image is lower than a predetermined standard and in a case where the control unit has determined that the area ratio is lower than the predetermined standard, the control unit preferably increases the transfer voltage to be applied at the time of transfer of the toner image.

(3) The image forming apparatus of Item. 1, wherein, based on the area ratio of the transferred image and the number of transferred sheets, the control unit preferably causes a toner pattern for forming a patch image to be formed at a portion other than an image region that is a region for which an image is formed on the latent image bearing body, and the control unit preferably controls the transfer voltage to be applied at the time of transfer of the formed toner pattern to the image bearing body.

(4) The image forming apparatus of Item. 3, wherein the control unit preferably determines whether the area ratio of the transferred image is lower than a predetermined standard and in a case where the control unit has determined that the area ratio is lower than the predetermined standard, the control unit preferably increases the transfer voltage to be applied at the time of transfer of the toner pattern to be above the transfer voltage to be applied at the time of transfer of the toner image.

(5) The image forming apparatus of Item. 1, wherein, in a case where the area ratio of the image varies, the control unit, based on the area ratio of the transferred image and the number of transferred sheets before the variation, preferably controls the transfer voltage to be applied at the time of transfer of the toner image after the variation.

(6) The image forming apparatus of Item. 5, wherein, in a case where the area ratio of the image varies from a first area ratio to a second area ratio that is higher than the first area ratio, the control unit preferably increases the transfer voltage to be applied at the time of transfer of the toner image with the second area ratio to be above the transfer voltage to be applied at the transfer of the toner image with the first area ratio.

(7) The image forming apparatus of Item. 3, wherein, in a case where the area ratio of the image varies from a first area ratio to a second area ratio that is higher than the first area ratio, the control unit preferably increases the transfer voltage to be applied at the time of transfer of the toner pattern after the variation to be above the transfer voltage to be applied at the transfer of the toner image before the variation.

(8) To achieve the abovementioned object, according to an aspect, an image forming method reflecting one aspect of the present invention comprises: a step of supplying lubricant to a latent image bearing body on which an latent image is formed; a developing step of developing the latent image as a toner image by supplying the lubricant taken in from the latent image bearing body to the latent image bearing body together with charged toner; a transfer step of transferring the toner image to an image bearing body at a transfer position by applying a transfer voltage to the toner image developed in the developing step; and a control step of controlling application of the transfer voltage at the transfer position, wherein the lubricant is charged to a polarity opposite to a charging polarity of the toner, and based on an area ratio of a transferred image and the number of transferred sheets at a certain timing, the control unit controls the transfer voltage at the transfer position after the certain timing.

(9) The image forming method of Item. 8, wherein the control step preferably determines whether the area ratio of the transferred image is lower than a predetermined standard and in a case where the control step has determined that the area ratio is lower than the predetermined standard, the control step preferably increases the transfer voltage to be applied at the time of transfer of the toner image.

(10) The image forming method of Item. 8, wherein, based on the area ratio of the transferred image and the number of transferred sheets, the control step preferably causes a toner pattern for forming a patch image at a portion other than an image region that is a region for which an image is formed on the latent image bearing body, and the control step preferably controls the transfer voltage to be applied at the time of transfer of the formed toner pattern to the image bearing body.

(11) The image forming method of Item. 10, wherein the control step preferably determines whether the area ratio of the transferred image is lower than a predetermined standard and when the control step has determined that the area ratio is lower than the predetermined standard, the control step preferably increases the transfer voltage to be applied at the time of transfer of the toner pattern to be above the transfer voltage to be applied at the time of transfer of the toner image.

(12) The image forming method of Item. 8, wherein, in a case where the area ratio of the image varies, the control step, based on the area ratio of the transferred image and the number of transferred sheets before the variation, preferably controls the transfer voltage to be applied at the time of transfer of the toner image after the variation.

(13) The image forming method of Item. 12, wherein, in a case where the area ratio of the image varies from a first area ratio to a second area ratio that is higher than the first area ratio, the control step preferably increases the transfer voltage to be applied at the time of transfer of the toner image with the second area ratio to be above the transfer voltage to be applied at the time of the transfer of the toner image with the first area ratio.

(14) The image forming method of Item. 10, wherein, in a case where the area ratio of the image varies from a first area ratio to a second area ratio that is higher than the first area ratio, the control step preferably increases the transfer voltage to be applied at the time of transfer of the toner pattern after the variation to be above the transfer voltage to be applied at the time of the transfer of the toner image before the variation.

(15) To achieve the abovementioned object, according to an aspect, a non-transitory recording medium storing a computer readable transfer voltage control program reflecting one aspect of the present invention causes a computer to execute: a step of supplying lubricant to a latent image bearing body on which an latent image is formed; a developing step of developing the latent image as a toner image by supplying the lubricant taken in from the latent image bearing body to the latent image bearing body together with charged toner; a transfer step of transferring the toner image to an image bearing body at a transfer position by applying a transfer voltage to the toner image developed in the developing step; and a control step of controlling application of the transfer voltage at the transfer position, wherein the lubricant is charged to a polarity opposite to a charging polarity of the toner, and based on an area ratio of a transferred image and the number of transferred sheets at a certain timing, the control step controls the transfer voltage at the transfer position after the certain timing.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

Figure 1:
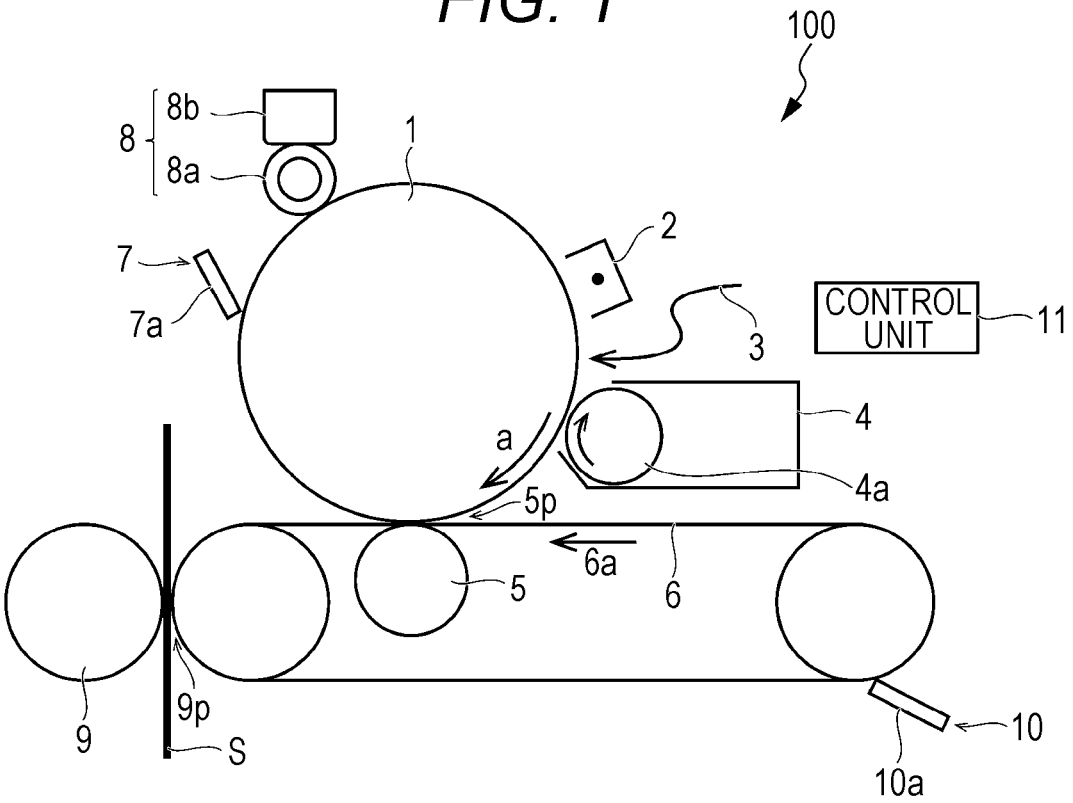
FIG. 1 is a diagram illustrating a schematic configuration of an image forming apparatus according to an embodiment of the present invention.

Hereinafter, an embodiment of the present invention will be described with reference to the drawings. However, the scope of the invention is not limited to the illustrated examples. In describing the drawings, a same reference sign will be given to same components and overlapping description will be omitted. Note that, for the purpose of explanation, proportions of dimensions in the drawings may be expanded and may differ from the proportions in reality in some cases.

First Embodiment

FIG. 1 is a diagram illustrating a schematic configuration of an image forming apparatus 100 according to an embodiment of the present invention.

As illustrated in FIG. 1, the image forming apparatus 100 includes a photoreceptor 1, namely, a latent image bearing body, a charging apparatus 2, an exposure apparatus 3, a developing apparatus 4, a transfer apparatus 5, an intermediate transfer body 6, namely, an image bearing body, a cleaning apparatus 7, and a lubricant application apparatus 8. The photoreceptor 1 is drum-shaped, rotationally driven in the a-direction in FIG. 1. The charging apparatus 2 uniformly charges a surface of the photoreceptor 1. The exposure apparatus 3 exposes the surface of the photoreceptor 1 charged by the charging apparatus 2 and forms an electrostatic latent image. The developing apparatus 4 functions as a developing unit and visualizes the electrostatic latent image formed on the photoreceptor 1 by the exposure apparatus 3 as a toner image by using a developer including both charged toner (charged in a negative polarity in the present embodiment) and lubricant. The transfer apparatus 5 functions as a transfer unit and transfers, at a transfer position 5*p*, the toner image formed on the photoreceptor 1 to the intermediate transfer body 6. The cleaning apparatus 7 removes the toner on the photoreceptor 1 that has passed through the transfer position 5*p*. The lubricant application apparatus 8 functions as a lubricant supplying unit and supplies lubricant to the surface of the photoreceptor 1.

The image forming apparatus 100 further includes a secondary transfer apparatus 9 and an intermediate-transfer-body cleaning apparatus 10 at a position in proximity to the intermediate transfer body 6. The secondary transfer apparatus 9 transfers a toner image transferred to the intermediate transfer body 6 to a recording material at a secondary transfer position 9*p*. The intermediate transfer body 6 is travelably supported by a plurality of rollers and driven to travel in the arrow 6*a* direction in FIG. 1. The intermediate-transfer-body cleaning apparatus 10 removes the toner on the intermediate transfer body 6 that has passed through the secondary transfer position 9*p*. The recording material to which the toner image has been transferred is conveyed to a fixing apparatus (not illustrated), heated and press-contacted. With this operation, the toner image is fixed on the recording material.

Each of the above-described portions of the image forming apparatus 100 is connected with the control unit 11 and appropriately controlled by the control unit 11. A CPU (not illustrated) configured to be a portion of the control unit 11 executes processes including transfer voltage control processing on the transfer apparatus and patch image formation processing on an image forming unit. Details of these processes will be described below. Programs corresponding to these processes are stored in a storage unit (not illustrated) included in the control unit 11. Each of functions of the above-described portions of the image forming apparatus 100 is effectively provided by execution of the corresponding programs by the CPU.

Hereinafter, configuration of each of the above-described components will be described in detail.

The photoreceptor 1 is configured, for example, with an organic photoreceptor, which has a photosensitive layer configured with resin containing organic photoconductor on an outer peripheral surface of a drum-shaped metal substrate. Examples of resin to configure the photosensitive layer include polycarbonate resin, silicone resin, polystyrene resin, acrylic resin, methacrylic resin, epoxy resin, polyurethane resin, vinyl chloride resin, and melamine resin.

The charging apparatus 2 is configured, for example, with a charger and charges the photoreceptor 1 to have a constant level of potential.

The exposure apparatus 3 includes, for example, a laser, and forms an electrostatic latent image on a surface of the photoreceptor 1.

The developing apparatus 4 includes a developing sleeve 4*a* arranged to face the photoreceptor 1 via the developing position. To the developing sleeve 4*a*, for example, a DC developing bias with a same polarity as a charging polarity of the charging apparatus 2 is applied, or a developing bias that is an AC voltage superimposed with a DC voltage having the same polarity as the charging polarity of the charging apparatus 2 is applied. This operation enables reversal development in which toner is attached to the electrostatic latent image formed by the exposure apparatus 3.

A portion of the developing sleeve 4*a* is abutted against or brought close to the surface of the photoreceptor 1. With this configuration, a portion of the lubricant supplied to the surface of the photoreceptor 1 by the lubricant application apparatus 8 is scratched by the developing sleeve 4*a* and taken into the inside of the developing apparatus 4. The lubricant taken into the inside of the developing apparatus 4 is mixed with the toner while being conveyed inside the developing apparatus 4. The lubricant mixed with the toner is re-supplied to the photoreceptor 1 together with the toner when development is performed.

At this time, an image with a low area ratio, such as a text document, for example, uses a small amount of toner for developing, namely, the toner consumption amount is small. Accordingly, when a low area ratio image is formed, the amount of lubricant to be re-supplied with the toner from the developing apparatus 4 would be small. In contrast, an image, for example, with a high area ratio such as a document including a photograph, consumes a great amount of toner, accordingly, the amount of lubricant re-supplied from the developing apparatus 4 together with the toner would be also great. Meanwhile, supply of lubricant onto the surface of the photoreceptor 1 from the lubricant application apparatus 8, and intake of lubricant into the inside of the developing apparatus 4 from the surface of the photoreceptor 1 are not very much influenced by the area ratio of the image to be formed and the toner consumption amount. Accordingly, forming a low area ratio image would increase the amount of lubricant inside the developing apparatus 4. Conversely, forming a high area ratio image would decrease the amount of lubricant inside the developing apparatus 4.

The charging apparatus 2, the exposure apparatus 3, and the developing apparatus 4 are configured to form the image forming unit. The toner image formed on the photoreceptor 1 by the developing apparatus 4 is conveyed to the transfer position 5*p* formed between the photoreceptor 1 and the transfer apparatus 5.

The transfer apparatus 5 applies a voltage having a polarity opposite to the charging polarity of the toner at the transfer position 5*p*. This application of voltage by the transfer apparatus 5 allows the toner image on the photoreceptor 1 to be transferred onto the intermediate transfer body 6.

The intermediate transfer body 6 is, for example, a transfer belt, and is driven to travel while being stretched by a plurality of rollers including a driving roller. The intermediate transfer body 6 moves the toner image transferred on the surface of the photoreceptor 1 to the secondary transfer position 9*p*. The intermediate transfer body 6 and its related configuration will be described below.

At the transfer position 5*p*, the toner that has not been transferred onto the intermediate transfer body 6 and remaining on the photoreceptor 1 is conveyed to a position where the cleaning apparatus 7 is provided, and then, the toner is recovered by the cleaning apparatus 7.

The cleaning apparatus 7 includes a plate-shaped cleaning blade 7*a* formed of an elastic body. The cleaning apparatus 7 causes the cleaning blade 7*a* to be abutted against the surface of the photoreceptor 1 so as to remove the toner remaining on the photoreceptor 1.

The lubricant application apparatus 8 includes a rotating body 8*a* and a solid lubricant 8*b*.

The rotating body 8*a*, while rotating, comes in contact with the solid lubricant 8*b* and scrapes a portion of the solid lubricant 8*b*. The rotating body 8*a* applies the scraped portion of solid lubricant 8*b* onto the photoreceptor 1 as lubricant. As the rotating body 8*a*, a brush roller would be suitably employed.

The solid lubricant 8*b* has, for example, a cuboid shape and is abutted against the rotating body 8*a* by a pressing member (not illustrated). The solid lubricant 8*b* wears by being scraped by the rotating body 8*a* and loses its thickness over time, while being constantly abutted against the rotating body 8*a* by a biasing force of the pressing member.

As the solid lubricant 8*b*, dry solid hydrophobic lubricant can be employed. It is possible to use materials having a stearic acid group including zinc stearate, barium stearate, lead stearate, iron stearate, nickel stearate, cobalt stearate, copper stearate, strontium stearate, calcium stearate, cadmium stearate, and magnesium stearate. It is also possible to employ other materials having a fatty acid group including zinc oleate, manganese oleate, iron oleate, cobalt oleate, lead oleate, magnesium oleate, copper oleate, palmitic acid, zinc palmitate, cobalt palmitate, copper palmitate, magnesium palmitate, aluminum palmitate, and calcium palmitate. Examples of other fatty acid and fatty acid metal salt that can be used include lead caprylate, lead caproate, zinc linoleate, cobalt linoleate, calcium linoleate, and cadmium ricolinoleate. Moreover, it is also possible to use wax such as candelilla wax, carnauba wax, rice wax, Japan wax, jojoba oil, beeswax, and lanolin. Using these types of lubricant makes it is possible to reduce side effects and improve extensibility onto the photoreceptor 1 and the intermediate transfer body 6. According to the present embodiment, lubricant is charged to a positive polarity, opposite to the charging polarity of the toner.

Next, the intermediate transfer body 6 and its related configuration will be described in detail.

The intermediate transfer body 6 is an endless belt and has a base body that is formed of a heat-resistant material such as a polyimide and a polyamide and is adjusted to a medium resistance.

The toner image transferred from the photoreceptor 1 onto the intermediate transfer body 6 by the transfer apparatus 5 is conveyed to the secondary transfer position 9*p* formed between the intermediate transfer body 6 and the secondary transfer apparatus 9.

At the secondary transfer position 9*p*, the secondary transfer apparatus 9 applies a voltage having polarity opposite to the charging polarity of the toner. This operation allows the toner image on the intermediate transfer body 6 to be transferred onto a recording material S.

The intermediate-transfer-body cleaning apparatus 10 includes a plate-shaped intermediate-transfer-body cleaning blade 10*a* formed of an elastic body. The intermediate-transfer-body cleaning apparatus 10 allows an edge portion (end portion) of the intermediate-transfer-body cleaning blade 10*a* to be abutted against a surface of the intermediate transfer body 6 at a position facing the rotating body that stretches the intermediate transfer body 6. With this configuration, the intermediate-transfer-body cleaning apparatus 10 removes the toner remaining on the intermediate transfer body 6.

Physical properties such as impact resilience and hardness of the intermediate-transfer-body cleaning blade 10*a* can be set to a suitable value appropriately by a person skilled in the art. For example, impact resilience is set to 10 to 80% at a temperature 25° C. More desirable setting value would be 30 to 70%. Meanwhile, JIS-Ahardness is set to 20° to 90°. More desirable setting value would be 60° to 80°. In a case where JIS-A hardness is smaller than 20°, the intermediate-transfer-body cleaning blade 10*a* would be too soft, and thus, it is likely to cause curling up of the blade. In contrast, in a case where JIS-A hardness is greater than 90°, it is difficult to cause the blade to follow slight irregularities of the intermediate transfer body 6 and foreign objects. In this case, it is likely that toner particles pass through the intermediate-transfer-body cleaning blade 10*a*, leading to a cleaning failure.

An abutting load of the intermediate-transfer-body cleaning blade 10*a* with respect to the intermediate transfer body 6 is set, for example, to 0.1 to 30 N/m. More desirable value would be 1 to 25 N/m. In a case the abutting load is smaller than 0.1 N/m, it is likely that cleaning power would be insufficient, causing a stain in an image. Conversely, in a case where the abutting load is greater than 30 N/m, more frictional force is generated at the intermediate transfer body 6 and thus it is like to cause image thinning, or the like. Measurement of the abutting load uses a method in which an end of the intermediate-transfer-body cleaning blade 10*a* is pressed against a scale and a method in which a sensor such as a load cell is arranged at the abutting position at the end of the intermediate-transfer-body cleaning blade 10*a* that corresponds to the intermediate transfer body 6 so as to measure the abutting load electrically.

Next, actions of the above-configured image forming apparatus 100 will be described.

<Actions>

The image forming apparatus 100 controls a transfer voltage based on the area ratio of an image and the number of transferred sheets, thereby controlling the amount of lubricant to move from the photoreceptor 1 onto the intermediate transfer body 6. Hereinafter, details will be described.

First, how the amount of lubricant to move from the photoreceptor 1 onto the intermediate transfer body 6 is controlled by controlling the transfer voltage will be described with reference to a result of evaluation experiments.

<Lubricant Movement Amount Control by Transfer Voltage>

First, an apparatus to be used for evaluating the lubricant movement amount control by the transfer voltage will be described.

Figure 2A:
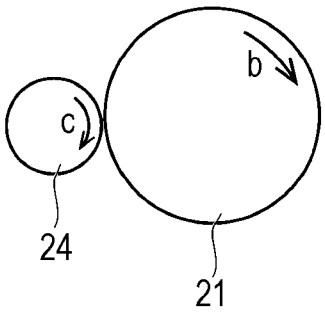
FIGS. 2A and 2B are diagrams illustrating an apparatus for evaluating lubricant amount control at a transfer position.
Figure 2B:
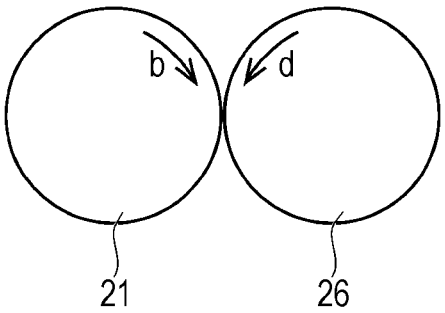

FIGS. 2A and 2B are diagrams illustrating an apparatus to be used for evaluating lubricant amount control at a transfer position. FIG. 2A illustrates a configuration that corresponds to the photoreceptor 1 and the developing sleeve 4*a*. FIG. 2B illustrates a configuration that corresponds to the photoreceptor 1 and the intermediate transfer body 6.

As illustrated in FIGS. 2A and 2B, an evaluation apparatus includes a photoreceptor roller 21 that corresponds to the photoreceptor 1, a developing roller 24 that corresponds to the developing sleeve 4*a*, and a rubber roller 26 that corresponds to the intermediate transfer body 6.

The photoreceptor roller 21 is a photoreceptor on which a photosensitive layer having a thickness of 25 μm formed of polycarbonate resin is provided on a surface of an aluminum cylindrical member having a diameter (ϕ) of 100 mm and a length of 100 mm. The photoreceptor roller 21 is connected to GND. The photoreceptor roller 21 is formed, for example, by using an aluminum-deposited PET film such as "metalumy" produced by TORAY ADVANCED FILM Co., Ltd.

The developing roller 24 is a developing roller having a diameter (ϕ) of 30 mm and holds developer of 250 g/m$^2$ at a circumferential surface of an aluminum sleeve.

The photoreceptor roller 21 and the developing roller 24 face each other with a distance of 250 μm in between.

To the developing roller 24, AC voltage having a frequency of 6000 Hz, an amplitude of 800 V, and an offset of −450 V is applied. Under this condition, the developing roller 24 is rotated in the c-direction in FIG. 2A at a speed of 600 mm/sec. Thereafter, the photoreceptor roller 21 is driven one revolution in the b-direction in FIG. 2A at a speed 400 mm/sec. With this procedure, a toner layer of 5 g/m$^2$ is formed on the photoreceptor roller 21.

Next, the developing roller 24 is separated from the photoreceptor roller 21, and the rubber roller 26 having a conductive rubber layer on a surface thereof is abutted against the photoreceptor roller 21. In this state, a certain level of voltage is applied to a core metal of the rubber roller 26 so as to drive the photoreceptor roller 21 one revolution in the b-direction in FIG. 2B at a speed of 400 mm/sec. The rubber roller 26 is abutted against the photoreceptor roller 21, and thus, rotates in the d-direction in FIG. 2B in accordance with the photoreceptor roller 21. After one revolution of the photoreceptor roller 21, the toner image on the photoreceptor roller 21 has been transferred onto the rubber roller 26.

Experiments have been performed with different voltages to be applied to the rubber roller 26 and the amount of toner and the amount of lubricant remaining on the photoreceptor roller 21 at this time have been measured.

Based on the amount of toner formed on the photoreceptor roller 21 and the amount of toner remaining on the photoreceptor roller 21 after the transfer, transfer efficiency has been obtained.

Transfer efficiency has been calculated, as an example, based on the following formula.

Transfer efficiency=(1−remaining toner amount on photoreceptor roller 21 after transfer/toner amount on photoreceptor roller 21 after developing)×100(%)

The amount of lubricant has been calculated based on a ratio of zinc in zinc stearate, obtained by X-ray photoelectron spectroscopy.

Results on the above-described calculation will be described with reference to FIG. 3.

Figure 3:
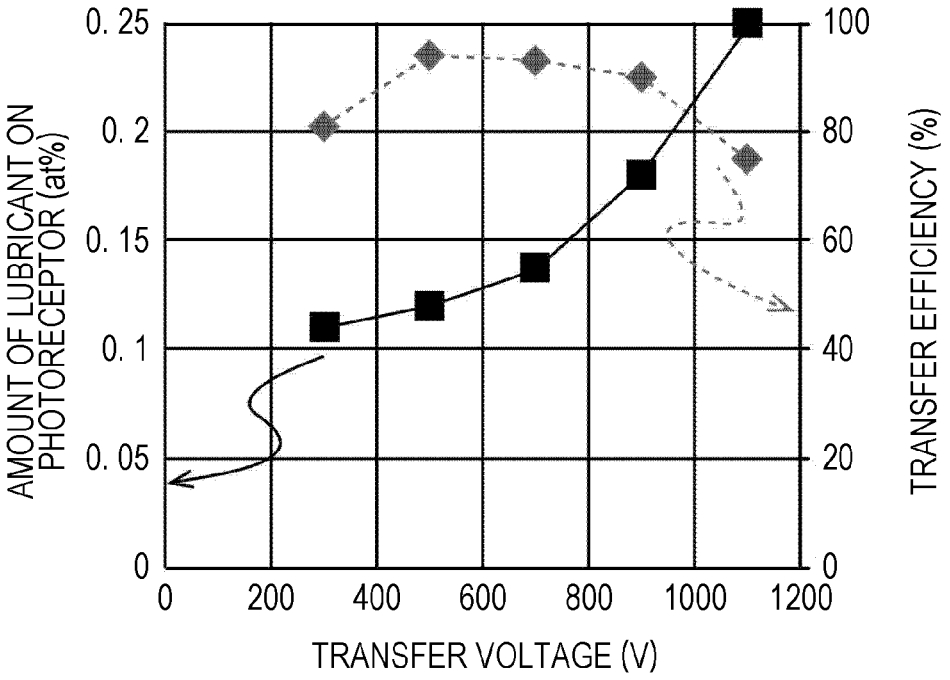
FIG. 3 is a diagram illustrating a relationship between a transfer voltage and the amount lubricant on a photoreceptor, and a relationship between the transfer voltage and transfer efficiency.

FIG. 3 is a diagram illustrating a relationship between the transfer voltage and the amount of lubricant on a photoreceptor 1, and a relationship between the transfer voltage and transfer efficiency. FIG. 3 includes data of the amount of lubricant on the photoreceptor 1 (solid line) with respect to the transfer voltage, and data of transfer efficiency (dotted line) with respect to the transfer voltage.

As illustrated in FIG. 3, when the transfer voltage is increased, the amount of lubricant remaining on the photoreceptor roller 21 increases. This means when the transfer voltage is increased, the amount of lubricant to be transferred to the rubber roller 26 decreases. Accordingly, it is understandable that, by increasing the transfer voltage, it is possible to reduce the amount of lubricant moved from the photoreceptor 1 onto the intermediate transfer body 6.

As illustrated in the above-described evaluation result, the amount of lubricant moved from the photoreceptor 1 onto the intermediate transfer body 6 can be controlled by a transfer voltage value.

In addition, as illustrated in FIG. 3, it is understandable that transfer efficiency is high in a certain range of transfer voltage. As illustrated in an example of FIG. 3, transfer efficiency is higher in a case where the transfer voltage is in a range of approximately 500 to 900 V than a case where the transfer voltage is in the other ranges. As long as merely transfer efficiency is considered, it would be appropriate to select 500 V as the transfer voltage so as to minimize power consumption. In view of an increase in the amount of lubricant on the photoreceptor 1, however, it is understandable that a desirable transfer voltage setting would be around 700 V, for example. Note that the above-described value that has been set as the transfer voltage in the present example is not limiting. It is possible to appropriately set a suitable transfer voltage according to various conditions including types of lubricant and machine configuration.

Next, a relationship between an image area ratio/the number of transferred sheets and the amount of lubricant on the intermediate transfer body 6 will be described with respect to results of evaluation experiments.

<Relationship Between Image Area Ratio/Number of Transferred Sheets and Amount of Lubricant on Intermediate Transfer Body>

First, machine configuration used to evaluate the relationship between an image area ratio/the number of transferred sheets and the amount of lubricant on the intermediate transfer body 6 will be described.

According to a configuration of the image forming apparatus 100 illustrated in FIG. 1, each of the photoreceptor 1, the developing apparatus 4, the transfer apparatus 5, the intermediate-transfer-body cleaning blade 10*a*, and the toner has been set as in the following.

(1) Photoreceptor 1

As the photoreceptor 1, a drum-shaped organic photoreceptor is used. On this organic photoreceptor, a photosensitive layer having a thickness of 25 μm formed of polycarbonate resin has been formed on an outer peripheral surface of a drum-shaped metal substrate made of aluminum. The photoreceptor 1 rotates at 400 mm/sec.

(2) Developing Apparatus 4

The developing apparatus 4 includes the developing sleeve 4*a* to be rotationally driven at a linear speed of 600 mm/min. A bias voltage that has a same polarity as that of a surface potential of the photoreceptor 1 is applied to the developing sleeve 4*a*, thereby executing reversal development using a two-component developer.

Toner included in the two-component developer is formed of toner particles having a volume-average particle diameter of 6.5 μm produced by emulsion polymerization and is negatively charged.

(3) Transfer Apparatus 5

As the intermediate transfer body 6, an endless transfer belt formed of polyimide resin to which conductivity has been given is used. As the transfer apparatus 5, a transfer roller that is abutted against the photoreceptor 1 via the intermediate transfer body 6 is provided. The transfer roller applies voltage having polarity opposite to the charging polarity of the toner.

(4) Intermediate-Transfer-Body Cleaning Blade 10*a*

The intermediate-transfer-body cleaning blade 10*a* that is employed is formed of urethane rubber and has impact resilience of 50% (25° C.), JIS-A hardness of 74°, a thickness of 2.00 mm, a free length of 9 mm, a width of 13 mm, and a full-length of 340 mm. The intermediate-transfer-body cleaning blade 10*a* has been set such that an abutting load with respect to the intermediate transfer body 6 would be 25 N/m, and an abutting angle would be 16°.

(5) Toner

Toner included in the two-component developer is formed of toner particles having a volume-average particle diameter of 6.5 μm produced by emulsion polymerization and is negatively charged.

In the above, a surface potential Vo of the photoreceptor 1 at a non-exposure region is set to −750 V, a surface potential Vi of the photoreceptor 1 at an exposure region is set to −100 V. A developing bias having a frequency of 6000 Hz, an amplitude of 800 V, a DC component of −550 V has been applied to the developing sleeve 4*a*. Using the above-described image forming apparatus 100, actual printing tests have been performed to inspect a cleaning failure occurrence status.

Figure 4:
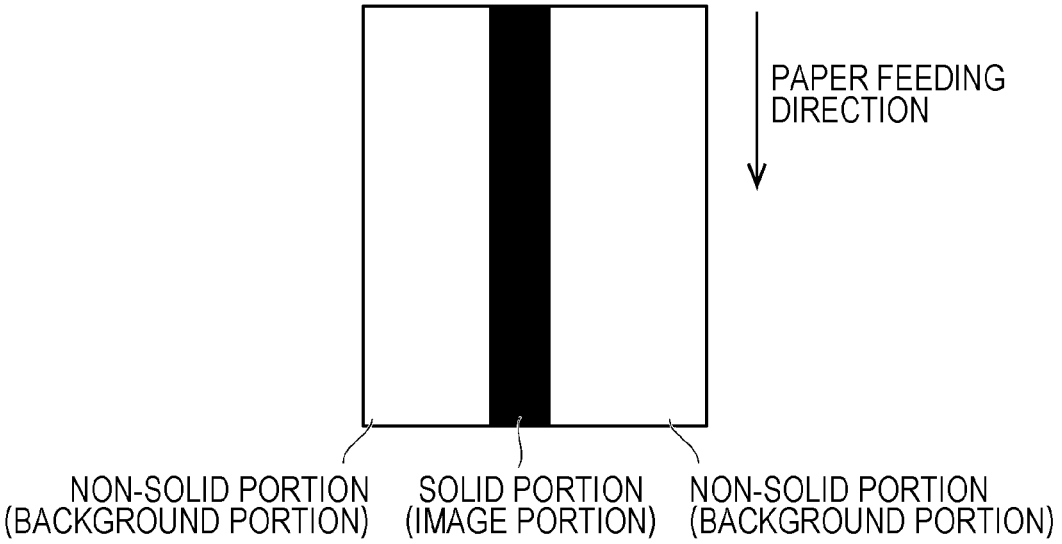
FIG. 4 is a diagram illustrating an image pattern (longitudinal band chart) to be used for evaluation of lubricant amount control.

FIG. 4 is a diagram illustrating an image pattern (longitudinal band chart) to be used for evaluation of lubricant amount control.

As illustrated in FIG. 4, a longitudinal band chart has been used as an image pattern used for evaluating lubricant amount control. By using the longitudinal band chart, it is possible to easily change the area ratio and easily distinguish an image portion from a background portion on an image region. The image portion is a portion where image formation is performed (solid portion) on the image region. The background portion is a portion where image formation is not performed (non-solid portion) on the image region.

First, while the transfer voltage is set to 500 V, 5000 sheets of longitudinal band charts having an area ratio of 0.3% are printed as low area ratio images. Thereafter, 1000 sheets of longitudinal band charts having an area ratio of 25% are printed as high area ratio images. Under this condition, the amount of lubricant inside the developing apparatus 4, releasability transition of the intermediate transfer body 6, presence/absence of a cleaning failure due to aggregates have been evaluated. According to the present embodiment, the area ratio is a ratio of the area of the image portion (solid portion) to the area of the image region. The transfer voltage of 500 V is a value set as a suitable value in view of power consumption and transfer efficiency.

Regarding measurement of the amount of lubricant inside the developing apparatus 4, 5000 sheets of longitudinal band charts having area ratio of 0.3%, and 1000 sheets of longitudinal band charts having area ratio of 25%, namely, a total of 6000 sheets have been printed, and thereafter, the amount of lubricant inside the developing apparatus 4 has been measured. The amount of lubricant inside the developing apparatus 4 has been calculated by recovering a small amount of developer from inside the developing apparatus 4. Subsequently, magnetized carrier has been removed from the developer such that a toner portion remains. The amount of lubricant has been calculated based on a ratio of zinc among zinc stearate obtained by X-ray photoelectron spectroscopy.

Regarding measurement of releasability transition of the intermediate transfer body 6, the intermediate transfer body 6 is removed from the image forming apparatus 100 while stopping actual imaging (printing) as needed, so as to measure a pure water contact angle on a surface of the intermediate transfer body 6. The measurement has been performed at a portion that corresponds to a position where the image portion of the longitudinal band chart is formed in a width direction intersecting a movement direction of the intermediate transfer body 6.

First, evaluation results on the amount of lubricant inside the developing apparatus 4, and on releasability transition of the intermediate transfer body 6 will be described with reference to FIGS. 5 and 6.

Figure 5:
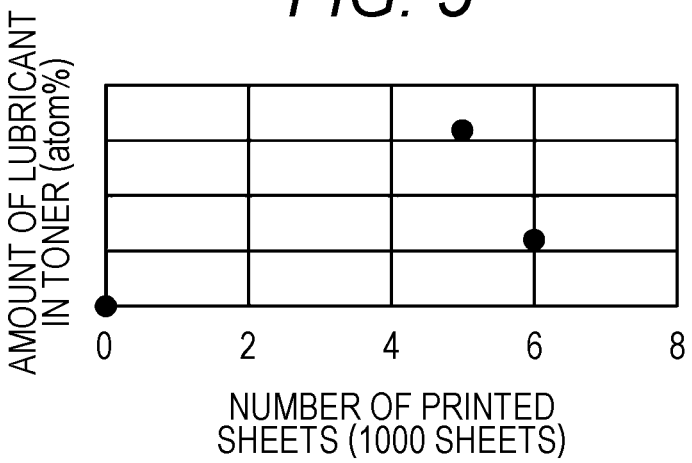
FIG. 5 is a diagram illustrating a relationship between the number of printed sheets and the amount of lubricant in toner.

FIG. 5 is a diagram illustrating a relationship between the number of printed sheets and the amount of lubricant in the toner. FIG. 6 is a diagram illustrating a relationship between the number of printed sheets and the pure water contact angle of the intermediate transfer body 6.

As illustrated in FIG. 5, the lubricant does not exist inside the developing apparatus 4 at an initial stage of printing (at a time when the number of printed sheets is zero). Accordingly, the amount of lubricant in the toner is zero. Thereafter, low area ratio charts with the area ratio of 0.3% are printed. At a time when 5000 sheets have been printed, the amount of lubricant in the toner is increased. Subsequently, when high area ratio charts with the area ratio of 25% are printed, the amount of lubricant in the toner is decreased.

This means, in printing, the lubricant supplied onto the photoreceptor 1 is scraped by the developing sleeve 4*a* of the developing apparatus 4 and then is recovered inside the developing apparatus 4, thereby increasing the amount of lubricant in the developing apparatus 4. Moreover, the amount of lubricant supplied from the developing apparatus 4 to the photoreceptor 1 when development is performed varies depending on the difference in the amount of toner supplied from the developing apparatus 4 to the photoreceptor 1 (or area ratio), leading to the increased amount of lubricant in the developer container in low area ratio printing compared with high area ratio printing.

Figure 6:
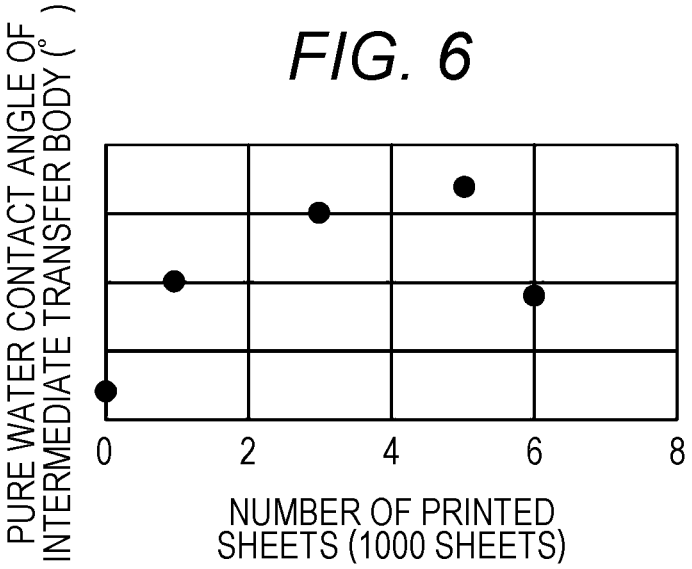
FIG. 6 is a diagram illustrating a relationship between the number of printed sheets and the a pure water contact angle of the intermediate transfer body.

As illustrated in FIG. 6, at initial printing (number of printed sheets: zero), the intermediate transfer body 6 has low releasability with a small pure water contact angle. After low area ratio charts with the area ratio of 0.3% have been printed, a portion on the intermediate transfer body 6 that corresponds to the image portion has shifted to have high releasability with a large pure water contact angle. This means, during low area ratio printing, the amount of lubricant inside the developing apparatus 4 is increased, and along with this, the amount of lubricant to be re-supplied together with the toner to the photoreceptor 1 is also increased. Accordingly, the amount of lubricant that moves to the intermediate transfer body 6 is increased, causing the intermediate transfer body 6 to have high releasability.

Subsequently, when high area ratio charts with the area ratio of 25% are printed, a portion on the intermediate transfer body 6 that corresponds to the image portion has shifted to have low releasability with a small pure water contact angle. This results from a fact that a cleaning failure occurs on a portion on the intermediate transfer body 6 that corresponds to the image portion, leading to toner contamination on the intermediate transfer body 6.

During the printing of 5000 sheets of longitudinal band charts with the area ratio of 0.3%, presence/absence of a cleaning failure attributable to aggregates has been evaluated at a timing when the printing is stopped for measuring the pure water contact angle of the intermediate transfer body 6. During the printing of 1000 sheets of longitudinal band charts with the area ratio of 25%, presence/absence of a cleaning failure is determined by stopping printing each time 250 sheets have been printed. Presence/absence of a cleaning failure has been determined by observation of a printed image, and a portion on the intermediate transfer body 6. Observation of the image has been performed with determination of whether a stripe-like black streak is generated in a sheet feeding direction at a position where the longitudinal band charts are interrupted on the sheet. Observation of the intermediate transfer body 6 is performed after an intermediate transfer unit including the intermediate transfer body 6 has been taken out from the image forming apparatus 100. It is determined whether the toner is attached in a stripe form to the intermediate transfer body 6 in a moving direction of the intermediate transfer body 6. In evaluation, the mark "x" is given to a case where a cleaning failure occurs, and the mark "○" is given to a case where no cleaning failure occurs. In addition to the above, presence/absence of aggregates has been checked by the observation of an edge portion of the intermediate-transfer-body cleaning blade 10*a*, corresponding to a portion at which the cleaning failure occurs. Results are illustrated in Table 1.

TABLE 1

| | | NUMBER OF PRINTED SHEETS (SHEETS) | | | | | | | |
|---|---|---|---|---|---|---|---|---|---|
| | LOCATION | 0 | 1000 | 3000 | 5000 | 5250 | 5500 | 5750 | 6000 |
| CLEANING FAILURE | IMAGE PORTION | ○ | ○ | ○ | ○ | x | | | |
| | BACKGROUND PORTION | ○ | ○ | ○ | ○ | ○ | ○ | ○ | ○ |
| AGGREGATE AT CLEANING BLADE EDGE PORTION OF INTERMEDIATE TRANSFER BODY | IMAGE PORTION | | | | | PRESENT | | | |
| | BACKGROUND PORTION | | | | | | | | ABSENT |

As illustrated in Table 1, a cleaning failure has occurred at a position that corresponds to the image portion of the longitudinal band chart at a time when 250 sheets of high area ratio charts with the area ratio of 25% have been printed (namely, at a time when the number of printed sheets is 5250 in Table 1). According to the observation on the edge portion of the intermediate-transfer-body cleaning blade 10*a*, aggregates including paper dust are present on a portion where the cleaning failure has occurred. The paper dust has become viscous, covered with the lubricant. In contrast, at a position that corresponds to the background portion of the longitudinal band chart, no cleaning failure has occurred at a time when 1000 sheets of high area ratio charts with the area ratio of 25% have been printed (at a time when the number of printed sheets reaches 6000 in Table 1). According to the observation on the edge portion of the intermediate-transfer-body cleaning blade 10*a*, no aggregates are present on a portion that corresponds to the background portion.

This results from a fact that switching from low area ratio printing to high area ratio printing while low area ratio printing has increased the amount of lubricant inside the developing apparatus 4 causes the toner containing a large amount of lubricant to be supplied, with the high area ratio, onto the photoreceptor 1 and the intermediate transfer body 6. This process temporarily increases the amount of lubricant that moves onto the portion on the intermediate transfer body 6 that corresponds to the image portion. Subsequently, the lubricant that has moved to the portion on the intermediate transfer body 6 that correspond to the image portion takes in the paper dust at a secondary transfer region and aggregates. The aggregate is caught on the edge of the intermediate-transfer-body cleaning blade 10*a* and causes the cleaning failure. In contrast, the toner is not supplied to the background portion, and accordingly, the amount of lubricant that moves onto the photoreceptor 1 and onto the intermediate transfer body 6 is small, causing no cleaning failure.

From the above, it is understandable that in a case where low area ratio printing has increased the amount of lubricant inside the developing apparatus 4, a cleaning failure occurs at a portion on the intermediate transfer body 6 that corresponds to the image portion.

Next, under the transfer voltage of 500 V, printing is executed with a different area ratio and the number of sheets to print. First, longitudinal band charts with the area ratio of 0.1% to 7% are printed initially on a predetermined number of sheets. Thereafter, 250 sheets of longitudinal band charts with the area ratio of 25% are printed. At this timing, presence/absence of a cleaning failure is evaluated. Results are illustrated in Table 2.

TABLE 2

| PRINTING | NUMBER OF PRINTED SHEETS (SHEETS) | | | | | | |
|---|---|---|---|---|---|---|---|
| RATIO (%) | 1000 | 2000 | 3000 | 4000 | 5000 | 6000 | 7000 |
| 0.1 | | | X | | | | |
| 0.3 | | | X | | X | | |
| 0.5 | | | ○ | X | | | |
| 1 | | | ○ | ○ | X | | |
| 3 | | | | ○ | x | | |
| 5 | | | | | ○ | ○ | ○ |
| 7 | | | | | | | |

As illustrated in Table 2, when 3000 sheets of longitudinal band charts with the area ratio of 0.3% or less are first printed and thereafter the longitudinal band charts with the area ratio of 25% are printed, a cleaning failure occurs. In a case where the area ratio is increased to 0.5% or more, even when 3000 sheets of longitudinal band charts with the area ratio of 0.5% or more are initially printed and thereafter the longitudinal band charts with the area ratio of 25% are printed, no cleaning failure occurs. In a case where the number of printed sheets has been increased to 5000 or more, a cleaning failure occurs even when the area ratio is 3%. However, in a case where longitudinal band charts with the area ratio of 5% or more are used, no cleaning failure occurs even when 5000 sheets or more are printed. In this manner, presence/absence of a cleaning failure on the intermediate transfer body 6 varies depending on the area ratio of the image and the number of printed sheets. This is because the amount of lubricant inside the developing apparatus 4 varies depending on the area ratio of the image and the number of printed sheets.

In the above-described example, when the charts with the area ratio of 5% or more is initially used, namely, when the longitudinal band charts with the area ratio of 25% are printed immediately after the charts with the area ratio of 5% or more have been printed, no cleaning failure occurs. This results from a fact that the lubricant is consumed together with the toner as needed, thus, the amount of toner inside the developing apparatus 4 rarely increases to an excessive level. Accordingly, even after the printing is switched from low area ratio printing to high area ratio printing, a large amount of lubricant is not like to move onto the intermediate transfer body 6.

In the above-described example, at the transfer voltage of 500 V, the images having the area ratio of 0.3% to 7% are printed as low area ratio images, and the images having the area ratio of 25% are printed as high area ratio images, for certain numbers of sheets. However, each of the setting values is merely an example and not limiting. The relationship between the transfer voltage, the area ratio of the image/the number of printed sheets, and presence/absence of a cleaning failure varies depending on various conditions including the type of lubricant and machine configuration. Accordingly, the setting values can be determined appropriately on each of persons skilled in the art. The same is applied to examples below.

As illustrated in the above-described evaluation results, presence/absence of a cleaning failure, namely, the amount of lubricant on the intermediate transfer body 6 varies depending on the area ratio of the transferred image and on the number of printed sheets at that time.

Next, in order to evaluate more specifically the relationship between the above-described transfer voltage and the amount of lubricant on the intermediate transfer body 6, and the relationship between the area ratio of the image/number of transferred sheets and the amount of lubricant on the intermediate transfer body 6, experiments have been executed as in Comparative Example 1 and Example 1. Results will be described below. Comparative Example 1 and Example 1 have been executed using the configuration illustrated in FIG. 1, similarly to the above-described evaluation experiment.

Comparative Example 1

In Comparative Example 1, while the transfer voltage (transfer bias) is set to a normal value of 500 V, 10000 sheets of longitudinal band charts having the area ratio of 0.3% are printed as low area ratio images. Under this condition, presence/absence of a cleaning failure is evaluated. Results are illustrated in Table 3.

TABLE 3

| | PRESENCE/ABSENCE OF PATCH | TRANSFER BIAS: IMAGE FORMING PORTION | TRANSFER BIAS: PATCH PORTION | LOCATION | NUMBER OF PRINTED SHEETS (SHEETS): 4000 | 5000 | 6000 | 7000 | 8000 | 9000 | 10000 | AREA RATIO/NUMBER OF SHEETS 25%/250 SHEETS |
|---|---|---|---|---|---|---|---|---|---|---|---|---|
| COMPARATIVE EXAMPLE 1 | ABSENT | 500 V | | IMAGE PORTION | ○ | ○ | ○ | X | | | | X |
| | | | | PATCH PORTION (BACKGROUND PORTION) | | | | | | | | |
| EXAMPLE 1 | ABSENT | 700 V | | IMAGE PORTION | ○ | ○ | ○ | ○ | ○ | ○ | ○ | X |
| | | | | PATCH PORTION (BACKGROUND PORTION) | | | | | | | | |

In Comparative Example 1 as illustrated in Table 3, a cleaning failure occurs at a time when 7000 sheets of longitudinal band charts with the area ratio of 0.3% have been printed, before printing of 10000 sheets are completed, at a portion that corresponds to the image portion (solid portion).

As described above, a cleaning failure occurs when printing is switched from low area ratio printing to high area ratio printing because toner containing the large amount of lubricant is moved with a high area ratio onto the intermediate transfer body 6. Meanwhile, in a case where printing is executed continuously with the low area ratio without switching from low area ratio printing to high area ratio printing, the toner containing the lubricant is continuously moved onto the intermediate transfer body 6 although the area ratio is low. With this operation, the amount of lubricant on the intermediate transfer body 6 increases and generates aggregates attributable to the lubricant. As a result, a cleaning failure occurs on the intermediate transfer body 6.

Example 1

As Example 1, using a higher level transfer voltage of 700 V, 10000 sheets of longitudinal band charts having the area ratio of 0.3% are printed as low area ratio images, similarly to Comparative Example 1. Under this condition, presence/absence of a cleaning failure is evaluated. Results are illustrated in Table 3.

In Example 1 as illustrated in Table 3, no cleaning failure occurs at a portion on the intermediate transfer body 6 that corresponds to the image portion, even after 10000 sheets of longitudinal band charts with the area ratio of 0.3% have been printed.

As illustrated in FIG. 3, when the transfer voltage is increased to a higher level (700 V in this example), the amount of lubricant remaining on the photoreceptor 1 increases when image transfer is performed. Accordingly, the amount of lubricant to move onto the intermediate transfer body 6 would be suppressed. As a result, occurrence of a cleaning failure would be suppressed.

In summary, the amount of lubricant that moves from the photoreceptor 1 onto the intermediate transfer body 6 can be controlled by a transfer voltage value. Presence/absence of a cleaning failure, namely, the amount of lubricant on the intermediate transfer body 6 varies depending on the area ratio of the transferred image and on the number of printed sheets at that time.

Accordingly, in the image forming apparatus 100 in the first embodiment, the control unit 11 is configured, based on the area ratio of the transferred image and on the number of transferred sheets at a certain timing, to control the transfer voltage after the certain timing. More particularly, the control unit 11 obtains the area ratio of the transferred image and on the number of transferred sheets at a certain timing based on print job details, history, or the like, stored in the storage unit. Based on the obtained area ratio of the transferred image and the number of transferred sheets, the control unit 11 estimates the amount of lubricant on the intermediate transfer body 6 at that time. Based on the estimated amount of lubricant, the control unit 11 changes the transfer voltage so as to adjust the amount of lubricant to be a suitable value. Herein, the above-described "certain timing" may include a certain time in the future, in addition to a certain time in the past and a present time. In a case a certain time in the future is set as the certain timing, the image forming apparatus 100 calculates an area ratio of a transferred image and the number of transferred sheets at the certain time in the future based on reserved print job details, a processing schedule, or the like. Based on a result of calculation, the image forming apparatus 100 controls the transfer voltage.

In addition, the control unit 11 determines whether the area ratio of the transferred image is lower than a predetermined standard, and in a case where the control unit 11 has determined that the area ratio is lower than the predetermined standard, the control unit 11 increases the transfer voltage. Herein, the predetermined standard varies depending on the type of lubricant, machine configuration, printing details, or the like, and thus, the person skilled in the art can set a suitable value appropriately. Regarding a predetermined standard, for example, a value of approximately 5% may be used for the setting as a standard value of the area ratio for a case where texts are uniquely formed in the image region. Alternatively, a statistic value such as an average value of the area ratio in the past printing may be used for the setting. Alternatively, a suitable value may be used appropriately for the setting by executing actual measurement and calculations as described above on individual image forming apparatuses.

As described above, the image forming apparatus 100 in the first embodiment is configured, based on the area ratio of the transferred image and on the number of transferred sheets at a certain timing, to control the transfer voltage after the certain timing. With this configuration, it is possible to control the amount of lubricant on the intermediate transfer body 6 even at the time of image transfer in the image region.

For example, the image forming apparatus 100 in the first embodiment determines whether the area ratio of the transferred image is lower than a predetermined standard and in a case where the image forming apparatus has determined that the area ratio is lower than the predetermined standard, the image forming apparatus increases the transfer voltage. With this operation, even when the area ratio of the transferred image is low and the amount of lubricant inside the developing apparatus 4 has been increased, it is possible to increase the amount of lubricant that is released from the toner at a time of transfer and remaining on the photoreceptor 1. As a result, it is possible to suppress the amount of lubricant to move onto the intermediate transfer body 6 and to suppress the amount of lubricant on the intermediate transfer body 6.

Second Embodiment

In the above-described first embodiment, as illustrated in the rightmost column in the result of Example 1 in Table 3, a cleaning failure occurs at a portion on the intermediate transfer body 6 that corresponds to the image portion, when 250 sheets of longitudinal band charts with the area ratio of 25% are printed after 10000 sheets of longitudinal band charts with the area ratio of 0.3% have been printed.

As described with reference to Table 2, the cleaning failure results from a fact that, when the printing is switched from low area ratio printing to high area ratio printing, the toner containing the large amount of lubricant moves, with a high area ratio, onto the intermediate transfer body 6.

In order to suppress such a movement of the toner containing a large amount of lubricant onto the intermediate transfer body 6, increasing the transfer voltage would be considered to be effective. As illustrated in FIG. 3, however, increasing the transfer voltage to an excessively high level might lower transfer efficiency. This would result from a fact that, if the transfer voltage is too high, charged toner would be discharged before reaching the transfer position 5*p*, leading to a failure in executing transfer of the toner suitably at the transfer position 5*p*. A decrease in transfer efficiency would influence the image. Therefore, there is an upper limit to the transfer voltage value that can be set during image formation.

In contrast, during formation of a patch image to be formed at a non-image region other than the image region, there are few restrictions of transfer efficiency and image quality, leading to few restrictions of the transfer voltage value. By forming a patch image, it is possible to reduce the amount of lubricant inside the developing apparatus 4. Furthermore, by setting the transfer voltage at a time of transfer of the patch image to a high value, it is possible to suppress the amount of lubricant that moves onto the intermediate transfer body 6. With this configuration, it is possible to further suppress the amount of lubricant that moves onto the intermediate transfer body 6.

Next, in order to evaluate more specifically the relationship between the above-described transfer voltage of the patch image and the amount of lubricant on the intermediate transfer body 6, experiments have been executed as in Comparative Example 2 and Example 2. Experiments of Comparative Example 2 and Example 2 have been executed using the configuration similar to Comparative Example 1 and Example 1.

First, the patch image to be formed in Comparative Example 1 and Example 1 will be described.

<Patch Image>

According to the image forming apparatus 100 in the present embodiment, the control unit 11 has a function to control an image forming unit so as to forma toner pattern (patch image) in a non-image region other than the image region (for example, a portion between one image region and next image region).

Figure 7:
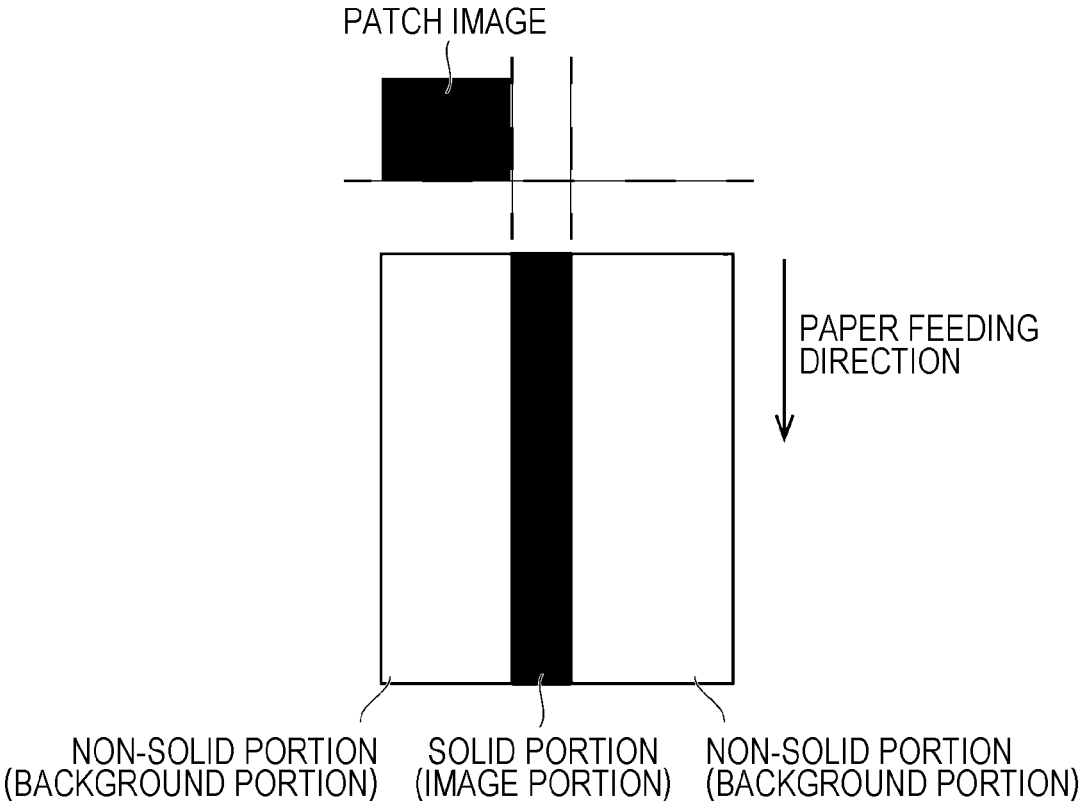
FIG. 7 is a diagram illustrating an exemplary patch image formed on an image forming apparatus.

FIG. 7 is a diagram illustrating an exemplary patch image formed on the image forming apparatus 100.

As illustrated in an upper portion of FIG. 7, the patch image is formed at a position between the images, namely, in an area other than the image region where the longitudinal band chart is formed. In the present example, the patch image is formed at a position that does not overlap with the image portion (solid portion) inside the image region viewed from a sheet feeding direction. The reason is, when a cleaning failure is detected on the formed image, this configuration would be useful to facilitate determination whether the cleaning failure is caused by the image or by the patch image. Note that, in the present embodiment, the area ratio of the patch image is calculated as a ratio of the area of the patch image to the area of the image region. Also note that the shape, location, size, or the like, are not limited to the example illustrated in FIG. 7 but can be formed in any shape, location, size, or the like. For example, the patch image may be formed in a band-shaped image extending longer than the image region in an axial direction of the photoreceptor 1.

The toner to be used for forming the patch image is defined to have a same configuration as the toner used for forming an ordinary toner image.

The image forming unit includes the charging apparatus 2, the exposure apparatus 3, and the developing apparatus 4, as described above. In forming the patch image, operation of at least one of these components is controlled. Specific methods for forming a patch image includes: (1) Method of temporarily stopping charging of the photoreceptor 1 provided by the charging apparatus 2, and subsequently allowing toner to be attached onto a whole surface of a non-charging image forming region so as to form a solid image; (2) Method of selectively emitting a light beam using the exposure apparatus 3 onto a region where the patch image should be formed, on a surface of the photoreceptor 1 uniformly charged by the charging apparatus 2, and subsequently allowing the toner to be attached onto an exposure region so as to form a solid image; and (3) Method of temporarily increasing a developing bias applied to the developing sleeve 4*a* of the developing apparatus 4, and subsequently allowing the toner to be attached so as to form a solid image. According to the present embodiment, in view of superiority in controlling the size of the patch image to form, the position of the photoreceptor 1 in an axial direction, image density, or the like, it is desirable to form the patch image using the above-described method (2) among these methods.

Comparative Example 2

In Comparative Example 2, while the transfer voltage is set to a normal value of 500 V, 10000 sheets of longitudinal band charts with the area ratio of 0.3% as low area ratio images are printed, and a lateral-band-shaped patch image is printed at a space between a longitudinal band chart and another longitudinal band chart. In the present embodiment, the size of the patch image is adjusted to the area ratio equivalent to 3%. Herein, the area ratio of the patch image corresponds to a ratio of the area of the patch image to the area of the image region. The transfer voltage at the time of printing the patch image is set to 500 V similarly to the case of printing the image. Under this condition, presence/absence of a cleaning failure is evaluated each time 1000 sheets are printed. Results are illustrated in Table 4.

TABLE 4

| | PRESENCE/ABSENCE OF PATCH | TRANSFER BIAS: IMAGE FORMING PORTION | TRANSFER BIAS: PATCH PORTION | LOCATION | NUMBER OF PRINTED SHEETS (SHEETS): 4000 | 5000 | 6000 | 7000 | 8000 | 9000 | 10000 | AREA RATIO/NUMBER OF SHEETS 25%/250 SHEETS |
|---|---|---|---|---|---|---|---|---|---|---|---|---|
| COMPARATIVE EXAMPLE 2 | PRESENT | 500 V | 500 V | IMAGE PORTION | ○ | ○ | ○ | ○ | ○ | ○ | ○ | ○ |
| | | | | PATCH PORTION (BACKGROUND PORTION) | ○ | ○ | ○ | ○ | X | | | |
| EXAMPLE 2 | PRESENT | 500 V | 700 V | IMAGE PORTION | ○ | ○ | ○ | ○ | ○ | ○ | ○ | ○ |
| | | | | PATCH PORTION (BACKGROUND PORTION) | ○ | ○ | ○ | ○ | ○ | ○ | ○ | |

In Comparative Example 2 as illustrated in Table 4, no cleaning failure occurs at a portion on the intermediate transfer body 6 that corresponds to the image portion, even after 10000 sheets of longitudinal band charts with the area ratio of 0.3% have been printed. Moreover, no cleaning failure occurs at a portion on the intermediate transfer body 6 that corresponds to the image portion, when 250 sheets of longitudinal band charts with the area ratio of 25% are printed after 10000 sheets of longitudinal band charts with the area ratio of 0.3% have been printed.

This results from a fact that printing the patch image has increased the area ratio (equivalent to 3.3%), and the lubricant is consumed together with the toner as needed. With this configuration, an increase in the amount of lubricant inside the developing apparatus 4 is suppressed, and thus, the amount of lubricant that moves onto the intermediate transfer body 6 together with the toner at the time of printing the longitudinal band charts with the area ratio of 0.3% would also be suppressed. As a result, occurrence of a cleaning failure is suppressed at a portion on the intermediate transfer body 6 that corresponds to the image portion.

At a time when 8000 sheets of longitudinal band charts with the area ratio of 0.3% have been printed, however, a cleaning failure has occurred at a portion that corresponds to the background portion of the longitudinal band chart. As a result of observation on the intermediate transfer body 6 while printing is stopped, the cleaning failure has occurred at a portion (patch portion) that corresponds to the patch image. Moreover, as a result of observation on the edge portion of the intermediate-transfer-body cleaning blade 10*a*, aggregates attributable to the lubricant have been detected at a position that corresponds to the position where the cleaning failure has occurred.

This results from a fact that, even though the increased area ratio of equivalent to 3.3% due to printing of the patch image suppresses an increase in the amount of lubricant inside the developing apparatus 4, the patch image portion is brought into a state having a high area ratio, and thus, the lubricant is supplied with the high area ratio together with the toner. In other words, toner containing the lubricant moves onto the intermediate transfer body 6 for the patch image portion. Accordingly, the amount of lubricant on the intermediate transfer body 6 is increased, leading to generation of aggregates attributable to the lubricant. As a result, a cleaning failure occurs at a portion on the intermediate transfer body 6 that corresponds to the patch image.

In the present example, the patch image is formed at a position that does not overlap with the image portion (solid portion) in the sheet feeding direction, namely, formed at a position that overlaps with the background portion. Accordingly, a cleaning failure occurring at the patch portion would influence the background portion of the longitudinal band chart. Although the image portion (solid portion) of the longitudinal band chart is not influenced, the background portion is influenced. This means the cleaning failure has influenced printing of the entire longitudinal band chart. Moreover, in a case where the patch image is formed so as to extend longer than the length of the image region in an axial direction of the photoreceptor 1, for example, a cleaning failure that occurs on the patch portion might influence the entire image region.

As illustrated in the above-described evaluation result, it is possible to control the amount of lubricant inside the developing apparatus 4 by controlling formation of the patch image. Still, it is not possible to control the amount of lubricant that moves onto the intermediate transfer body 6 at the patch image portion.

Example 2

In Example 2, similarly to Comparative Example 2, 10000 sheets of longitudinal band charts with the area ratio of 0.3% as low area ratio images are printed, while a lateral-band-shaped patch image is printed at a space between a longitudinal band chart and another longitudinal band chart. Herein, the transfer voltage at transferring the image portion is set to a normal value of 500 V, and the transfer voltage at a time of transfer of the patch image is increased to 700 V. Under this condition, presence/absence of a cleaning failure is evaluated. Results are illustrated in Table 4.

In Example 2 as illustrated in Table 4, no cleaning failure occurs at a portion on the intermediate transfer body 6 that corresponds to each of the image portion and the patch image, even after 10000 sheets of longitudinal band charts with the area ratio of 0.3% have been printed.

This results from a fact that, by increasing the transfer voltage of the patch image to 700 V while decreasing the amount of lubricant inside the developing apparatus 4 by formation of the patch image, it is possible to suppress the amount of lubricant that moves onto the intermediate transfer body 6 at a time of transfer of the patch image. As a result, occurrence of a cleaning failure is suppressed at a portion on the intermediate transfer body 6 that corresponds to each of the image portion and the patch image.

As illustrated in the above-described evaluation result, it is possible to control the amount of lubricant on the intermediate transfer body 6 by forming the patch image and controlling the transfer voltage at a time of transfer of the patch image.

Accordingly, in the image forming apparatus 100 in the second embodiment, the control unit 11 is configured to form a patch image on the photoreceptor 1 by controlling the image forming unit based on the area ratio of the transferred image and on the number of transferred sheets. Furthermore, the control unit 11 controls the transfer voltage when the patch image formed on the photoreceptor 1 is transferred to the intermediate transfer body 6. Specifically, based on the area ratio of the transferred image and on the number of transferred sheets, the control unit 11 estimates the amount of lubricant on the intermediate transfer body 6 at that time. Based on the estimated amount of lubricant on the intermediate transfer body 6, the control unit 11 forms a patch image so as to adjust the amount of lubricant to be a suitable value, and furthermore, changes the transfer voltage at a time of transfer of the patch image.

For example, the control unit 11 determines whether the area ratio of the transferred image is lower than a predetermined standard. When the control unit 11 has determined that the area ratio is lower than the predetermined standard, the control unit 11 controls the transfer apparatus 5 so as to increase the transfer voltage at the time of transfer of the patch image to be above the transfer voltage at a time of transfer of the image. Herein, similarly to the first embodiment, the predetermined standard varies depending on the type of lubricant, machine configuration, printing details, or the like. Accordingly, the person skilled in the art can set a suitable value appropriately.

As described above, according to the image forming apparatus 100 in the second embodiment, the patch image is formed and the transfer voltage applied to the patch image is controlled based on the area ratio of the transferred image and on the number of transferred sheets. While the amount of lubricant inside the developing apparatus 4 is controlled by forming the patch image, it is also possible to control the amount of lubricant, at a portion of the patch image, that moves onto the intermediate transfer body 6 by controlling the transfer voltage. As a result, it is possible to control the amount of lubricant on the intermediate transfer body 6 more effectively.

Furthermore, the image forming apparatus 100 according to the second embodiment determines whether the area ratio of the transferred image is lower than a predetermined standard. When the image forming apparatus 100 has determined that the area ratio is lower than the predetermined standard, the image forming apparatus 100 increases the transfer voltage at the time of transfer of the patch image to be above the transfer voltage at a time of transfer of the image. With this configuration, it is possible to suppress the amount of lubricant, at a portion of the patch image, that moves onto the intermediate transfer body 6 even when the area ratio of the patch image has been increased so as to reduce the amount of lubricant inside the developing apparatus 4. As a result, it is possible to suppress the amount of lubricant on the intermediate transfer body 6.

Third Embodiment

The image forming apparatus 100 according to the first embodiment controls the transfer voltage based on the area ratio of a transferred image and on the number of transferred sheets at a certain timing. The amount of lubricant on the intermediate transfer body 6, however, varies particularly largely when the area ratio of the image varies. Therefore, the configuration may be such that movement of the lubricant to the intermediate transfer body 6 is controlled by controlling the transfer voltage at a timing when the area ratio of the image varies.

In order to specifically evaluate transfer voltage control performed at a timing when the area ratio of the image varies, experiments have been executed as in Comparative Example 3 and Example 3. Experiments of Comparative Example 3 and Example 3 have been executed using a configuration similar to Comparative Examples 1 and 2, and Examples 1 and 2.

Comparative Example 3

In Comparative Example 3, while the transfer voltage is set to a normal value of 500 V, 3000 sheets of longitudinal band charts with the area ratio of 0.3% as low area ratio images are printed. Under this condition, presence/absence of a cleaning failure is evaluated. Thereafter, 250 sheets of longitudinal band charts with the area ratio of 25% as high area ratio images are printed. Also under this condition, presence/absence of a cleaning failure is evaluated. Results are illustrated in Table 5.

TABLE 5

| | PRESENCE/ABSENCE OF PATCH | TRANSFER BIAS: IMAGE FORMING PORTION | TRANSFER BIAS: PATCH PORTION | LOCATION | AREA RATIO/NUMBER OF SHEETS: 0.30%/3000 SHEETS | AREA RATIO/NUMBER OF SHEETS: 25%/250 SHEETS |
|---|---|---|---|---|---|---|
| COMPARATIVE EXAMPLE 3 | ABSENT | 500 V | | IMAGE PORTION | ○ | X |
| EXAMPLE 3 | ABSENT | 500 → 700 V | | IMAGE PORTION | ○ | ○ |

As illustrated in Table 5, no cleaning failure occurs at a portion on the intermediate transfer body 6 that corresponds to the image portion after 3000 sheets of longitudinal band charts with the area ratio of 0.3% as low area ratio images have been printed. However, after 250 sheets of longitudinal band charts with the area ratio of 25% as high area ratio images have been printed, a cleaning failure occurs at a portion on the intermediate transfer body 6 that corresponds to the image portion.

This results from a fact that, as illustrated in Table 2, switching from low area ratio printing to high area ratio printing while low area ratio printing has increased the amount of lubricant inside the developing apparatus 4 causes the toner containing a large amount of lubricant to be supplied onto the photoreceptor 1 and the intermediate transfer body 6. The amount of lubricant has increased at a portion on the intermediate transfer body 6 that corresponds to the image portion, and aggregates attributable to the lubricant are generated on the intermediate transfer body 6. This leads to occurrence of a cleaning failure at a portion on the intermediate transfer body 6 that corresponds to the image portion.

As illustrated in the above-described evaluation result, in a case where the area ratio of the image has varied, the amount of lubricant to be supplied to the photoreceptor 1 varies largely, and accordingly, the amount of lubricant to move onto the intermediate transfer body 6 also varies largely.

Example 3

In Example 3, similarly to Comparative Example 3, 3000 sheets of longitudinal band charts with the area ratio of 0.3% as low area ratio images have been printed, and thereafter, 250 sheets of longitudinal band charts with the area ratio of 25% as high area ratio images have been printed. At this time, unlike Comparative Example 3, the transfer voltage is set to normal value of 500 V during low area ratio printing, and the transfer voltage is increased to 700 V during high area ratio printing. Under this condition, presence/absence of a cleaning failure is evaluated. Results are illustrated in Table 5.

As illustrated in Table 5, no cleaning failure occurs at a portion on the intermediate transfer body 6 that corresponds to the image portion, in both of a case where 3000 sheets of longitudinal band charts with the area ratio of 0.3% as low area ratio images have been printed and a case where 250 sheets of longitudinal band charts with the area ratio of 25% as high area ratio images have been printed.

This results from a fact that, by increasing the transfer voltage at the time of high area ratio printing to 700 V, the amount of lubricant to move onto the intermediate transfer body 6 at the time of transfer of the image is suppressed. That is, while low area ratio printing has increased the amount of lubricant inside the developing apparatus 4, switching the printing to high area ratio printing causes the toner containing a large amount of lubricant to be supplied onto the photoreceptor 1. However, increasing the transfer voltage would increase the amount of lubricant remaining on the photoreceptor 1. Accordingly, the amount of lubricant to move onto the intermediate transfer body 6 would be suppressed. As a result, occurrence of a cleaning failure would be suppressed.

As illustrated in the above-described evaluation result, even in a case where the area ratio of the image has varied and the amount of lubricant to be supplied to the photoreceptor 1 varies largely, it is possible to control the amount of lubricant to move onto the intermediate transfer body 6 by controlling the transfer voltage. As a result, it is possible to control the amount of lubricant on the intermediate transfer body 6.

Accordingly, in the image forming apparatus 100 in the third embodiment, the control unit 11 is configured, based on the area ratio of the transferred image and on the number of transferred sheets before variation, to control the transfer voltage after the variation. Specifically, in a case where the area ratio of the image has varied, the control unit 11 estimates the amount of lubricant on the intermediate transfer body 6 at that time based on the area ratio of the transferred image and on the number of transferred sheets before the variation. Based on the estimated amount of lubricant on the intermediate transfer body 6, the control unit 11 changes the transfer voltage of the image so as to adjust the amount of lubricant to be a suitable value.

For example, when the area ratio of the image has varied from a low area ratio to a high area ratio, the control unit 11 increases the transfer voltage at high area ratio printing to be above the transfer voltage at low area ratio printing. With this operation, even when toner containing a large amount of lubricant is temporarily supplied with high area ratio to the photoreceptor 1 due to switching from low area ratio printing to high area ratio printing, it is possible to suppress the amount of lubricant that moves onto the intermediate transfer body 6. With this configuration, it is possible to suppress the amount of lubricant on the intermediate transfer body 6.

As described above, when the area ratio of the image has varied, the image forming apparatus 100 in the third embodiment is configured, based on the area ratio of the transferred image and on the number of transferred sheets before variation, to control the transfer voltage after the variation. Accordingly, even in a case where the area ratio of the image has varied and the amount of lubricant to be supplied to the photoreceptor 1 varies a largely, it is possible to control the amount of lubricant that moves onto the intermediate transfer body 6.

Moreover, when the area ratio of the image has varied from a low area ratio to a high area ratio, the image forming apparatus 100 according to the third embodiment increases the transfer voltage at high area ratio printing to be above the transfer voltage at low area ratio printing. With this operation, even when toner containing a large amount of lubricant is temporarily supplied with high area ratio to the photoreceptor 1, it is possible to increase the amount of lubricant that is released from the toner at the time of transfer and remains on the photoreceptor 1 and to suppress the amount of lubricant that moves onto the intermediate transfer body 6. As a result, it is possible to suppress the amount of lubricant on the intermediate transfer body 6.

In the above description, each of control processing in the first to third embodiments is processing independent from each other. However, aspects of the first to third embodiments may be combined. For example, it is possible to combine processing in the second embodiment and processing of the third embodiment. Specifically, it is possible to configure such that a patch image is formed between images, and to control such that, when the area ratio of the image has varied from a low area ratio to a high area ratio, the transfer voltage of the patch image is increased to be above the transfer voltage of the image before the area ratio has varied. With this configuration, even when the toner containing a large amount of lubricant is temporarily supplied with a high area ratio to the photoreceptor 1 due to a variation in the area ratio, it is possible to suppress the amount of lubricant, at a portion of the patch image, that moves onto the intermediate transfer body 6 and thus to suppress the occurrence of a cleaning failure.

In the above-described embodiments, the toner is charged in the negative polarity and the lubricant is charged in the positive polarity. However, the polarities are not limited to this pattern. That is, the toner may be charged in the positive polarity and the lubricant may be charged in the negative polarity. Moreover, the lubricant need not be charged at a time when it is supplied from the lubricant application apparatus 8 to the photoreceptor 1 and at a time when it is re-supplied from the developing apparatus 4 to the photoreceptor 1. The lubricant is only required to be charged in the polarity opposite to the polarity of the toner at least when the transfer voltage is applied at the transfer position 5*p*.

Techniques and methods to be used for executing various processing in the image forming apparatus 100 according to the above-described embodiments can be implemented by any of a dedicated hardware circuit and a computer programmed by a program. The above-described program may be provided in a computer-readable recording medium including a flexible disk, and a CD-ROM, or may be provided online via a network including the Internet. In this case, the program recorded in the computer-readable recording medium is generally transferred to a storage unit such as a hard disk and is stored in it. Alternatively, the above-described program may be provided as a separate piece of application software, or may be incorporated into software of the corresponding image forming apparatus 100 as a function of the same apparatus.

Although the present invention has been described and illustrated in detail, it is clearly understood that the same is by way of illustrated and example only and is not to be taken by way of limitation, the scope of the present invention being interpreted by terms of the appended claims.

What is claimed is:

1. An image forming apparatus comprising:

a latent image bearing body on which a latent image is formed;

a lubricant supplying unit configured to supply lubricant to the latent image bearing body;

a developing unit configured to develop the latent image as a toner image by supplying the lubricant taken in from the latent image bearing body to the latent image bearing body together with charged toner;

a transfer unit configured to transfer the toner image to an image bearing medium at a transfer position by applying a transfer voltage to the toner image developed by the developing unit; and a control unit configured to control application of the transfer voltage at the transfer position, wherein the lubricant is charged to a polarity opposite to a charging polarity of the charged toner at the transfer position, and based on an area ratio of a transferred image over an entire sheet and a number of transferred sheets at a certain timing, the control unit controls the transfer voltage to be applied at a time of transfer of the toner image after the certain timing.

2. The image forming apparatus according to claim 1, wherein the control unit determines whether the area ratio of the transferred image is lower than a predetermined standard and in a case where the control unit has determined that the area ratio is lower than the predetermined standard, the control unit increases the transfer voltage to be applied at the time of transfer of the toner image.

3. The image forming apparatus according to claim 1, wherein, based on the area ratio of the transferred image and the number of transferred sheets, the control unit causes a toner pattern for forming a patch image to be formed at a portion other than an image region that is a region for which an image is formed on the latent image bearing body, and the control unit controls the transfer voltage to be applied at the time of transfer of the formed toner pattern to the image bearing medium.

4. The image forming apparatus according to claim 3, wherein the control unit determines whether the area ratio of the transferred image is lower than a predetermined standard and in a case where the control unit has determined that the area ratio is lower than the predetermined standard, the control unit increases the transfer voltage to be applied at the time of transfer of the toner pattern to be above the transfer voltage to be applied at the time of transfer of the toner image.

5. The image forming apparatus according to claim 1, wherein, in a case where the area ratio of the image varies, the control unit, based on the area ratio of the transferred image and the number of transferred sheets before the variation, controls the transfer voltage to be applied at the time of transfer of the toner image after the variation.

6. The image forming apparatus according to claim 5, wherein, in a case where the area ratio of the image varies from a first area ratio to a second area ratio that is higher than the first area ratio, the control unit increases the transfer voltage to be applied at the time of transfer of the toner image with the second area ratio to be above the transfer voltage to be applied at the transfer of the toner image with the first area ratio.

7. The image forming apparatus according to claim 3, wherein, in a case where the area ratio of the image varies from a first area ratio to a second area ratio that is higher than the first area ratio, the control unit increases the transfer voltage to be applied at the time of transfer of the toner pattern after the variation to be above the transfer voltage to be applied at the transfer of the toner image before the variation.

8. The image forming apparatus according to claim 1, wherein the image bearing medium comprises an image bearing body.

9. An image forming method comprising:

a step of supplying lubricant to a latent image bearing body on which an latent image is formed;

a developing step of developing the latent image as a toner image by supplying the lubricant taken in from the latent image bearing body to the latent image bearing body together with charged toner;

a transfer step of transferring the toner image to an image bearing body medium at a transfer position by applying a transfer voltage to the toner image developed in the developing step; and a control step of controlling application of the transfer voltage at the transfer position, wherein the lubricant is charged to a polarity opposite to a charging polarity of the charged toner, and based on an area ratio of a transferred image over an entire sheet and a number of transferred sheets at a certain timing, the control unit controls the transfer voltage at the transfer position after the certain timing.

10. The image forming method according to claim 9, wherein the control step determines whether the area ratio of the transferred image is lower than a predetermined standard and in a case where the control step has determined that the area ratio is lower than the predetermined standard, the control step increases the transfer voltage to be applied at the time of transfer of the toner image.

11. The image forming method according to claim 9, wherein, based on the area ratio of the transferred image and the number of transferred sheets, the control step causes a toner pattern for forming a patch image at a portion other than an image region that is a region for which an image is formed on the latent image bearing body, and the control step controls the transfer voltage to be applied at the time of transfer of the formed toner pattern to the image bearing medium.

12. The image forming method according to claim 11, wherein the control step determines whether the area ratio of the transferred image is lower than a predetermined standard and when the control step has determined that the area ratio is lower than the predetermined standard, the control step increases the transfer voltage to be applied at the time of transfer of the toner pattern to be above the transfer voltage to be applied at the time of transfer of the toner image.

13. The image forming method according to claim 9, wherein, in a case where the area ratio of the image varies, the control step, based on the area ratio of the transferred image and the number of transferred sheets before the variation, controls the transfer voltage to be applied at the time of transfer of the toner image after the variation.

14. The image forming method according to claim 13, wherein, in a case where the area ratio of the image varies from a first area ratio to a second area ratio that is higher than the first area ratio, the control step increases the transfer voltage to be applied at the time of transfer of the toner image with the second area ratio to be above the transfer voltage to be applied at the time of the transfer of the toner image with the first area ratio.

15. The image forming method according to claim 11, wherein, in a case where the area ratio of the image varies from a first area ratio to a second area ratio that is higher than the first area ratio, the control step increases the transfer voltage to be applied at the time of transfer of the toner pattern after the variation to be above the transfer voltage to be applied at the time of the transfer of the toner image before the variation.

16. The image forming method according to claim 9, wherein the image bearing medium comprises an image bearing body.

17. A non-transitory recording medium storing a computer readable transfer voltage control program that causes a computer to execute:

a step of supplying lubricant to a latent image bearing body on which an latent image is formed;

a developing step of developing the latent image as a toner image by supplying the lubricant taken in from the latent image bearing body to the latent image bearing body together with charged toner;

a transfer step of transferring the toner image to an image bearing body medium at a transfer position by applying a transfer voltage to the toner image developed in the developing step; and a control step of controlling application of the transfer voltage at the transfer position, wherein the lubricant is charged to a polarity opposite to a charging polarity of the charged toner, and based on an area ratio of a transferred image over an entire sheet and a number of transferred sheets at a certain timing, the control step controls the transfer voltage at the transfer position after the certain timing.

18. The non-transitory recording medium according to claim 17, wherein the image bearing medium comprises an image bearing body.

* * * * *